US010119295B1

(12) United States Patent
Ruffin

(10) Patent No.: US 10,119,295 B1
(45) Date of Patent: Nov. 6, 2018

(54) WALLS TO TOP CLOSURE SYSTEM FOR TENTS

(71) Applicant: William J Ruffin, Evansville, IN (US)

(72) Inventor: William J Ruffin, Evansville, IN (US)

( * ) Notice: Subject to any disclaimer, the term of this patent is extended or adjusted under 35 U.S.C. 154(b) by 194 days.

(21) Appl. No.: 15/260,712

(22) Filed: Sep. 9, 2016

Related U.S. Application Data

(60) Provisional application No. 62/217,505, filed on Sep. 11, 2015.

(51) Int. Cl.
*E04H 15/34* (2006.01)
*E04H 15/32* (2006.01)
*B23P 19/04* (2006.01)

(52) U.S. Cl.
CPC ..... *E04H 15/32* (2013.01); *B23P 19/04* (2013.01)

(58) Field of Classification Search
CPC ..... E04H 15/644; E04H 15/18; E04H 15/46; E04H 15/642; E04H 15/322; E04H 15/32; E04H 15/54; Y10T 403/61; Y10T 156/1317; Y10T 24/44043
See application file for complete search history.

(56) References Cited

U.S. PATENT DOCUMENTS 6,273,114 B1 * 8/2001 Schaefer ..... E04H 15/18 135/128
6,564,513 B2 * 5/2003 Henbid ..... E04H 15/18 160/394
8,051,867 B2 * 11/2011 Hamilton-Jones .... E04H 15/642 135/115
2007/0062567 A1 * 3/2007 Warner ..... E04H 15/18 135/97

* cited by examiner

*Primary Examiner* — Jun Yoo
(74) *Attorney, Agent, or Firm* — Gary K. Price

(57) ABSTRACT

A connecting member acts as a seam connecting the side panels and the top panels of a tent. The tent side panels define a keder for engagement with a first channel of the connecting member. The top panels also define a keder for engagement with a second channel of the connecting member. The user inserts an end of the side keder into the corresponding first channel of the connecting member. Once the end of the side keder is engaged by the connecting member, the connecting member is horizontally pushed toward the opposite end of the side panel until the connecting member reaches the opposite end of the side panel. The user then inserts an end of the top keder into the corresponding second channel of the connecting member. The second channel of the connecting member (along with the side wall) is horizontally pushed along the top keder until the channel is in receipt of the entire length of the top keder.

13 Claims, 5 Drawing Sheets

WALLS TO TOP CLOSURE SYSTEM FOR TENTS

CROSS REFERENCES TO RELATED APPLICATIONS

U.S. Provisional Application Patent No. 62/217,505, filed Sep. 11, 2015, with title "Walls to Top Closure System for Tents" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates generally to devices and methods for assembling tents and more particularly for assembling a weather-tight connection of the fabric walls of the tent to the fabric top.

2. Brief Description of Prior Art

Tents can be very large and can be used for providing a shelter and an environment for large gatherings and celebrations such as wedding receptions and conventions. For these large tents, the top of the tent is often supported by pole members and tensioned to the ground with guys and stakes.

Some styles of pole tents that are often used for events are often considered appropriate only when there is no chance of inclement weather, due to lighter construction and the inability to effectively seal the walls of the tent to the top. The prior art often employs hook and loop fasteners (i.e. Velcro) or snap, hook, or cable fasteners for connecting the wall panels to the top. These prior art methods often present wrinkles, and gaps along the eave line which results in inclement weather such as wind and rain interrupting the gathering inside the tent.

As will be seen from the subsequent description, the preferred embodiments of the present invention overcome disadvantages of the prior art. In this regard, the present walls to top closure system for tents provides an improved tent, an improved method of assembling a tent, and particularly an improved method for causing a weather-tight sealed connection between the walls of the tent and the top. Still other objects will become apparent from the more detailed description which follows.

SUMMARY OF THE INVENTION

A connecting member acts as a seam connecting the side panels and the top panels of a tent. The tent side panels include a keder for engagement with a first channel of the connecting member. The top panels also include a keder for engagement with a second channel of the connecting member. The first and second channels each define narrow openings that extend the length of the channels to prevent the keders (sides and top) from being laterally pulled from the first and second channels.

In application, the user horizontally installs the first channel of the connecting member to the entire length of the side panel keder by inserting an end of the side panel into the corresponding first channel of the connecting member. Once the end of the side panel keder is engaged by the connecting member, the connecting member is horizontally pushed toward the opposite end of the side panel until the connecting member reaches the opposite end of the side panel.

The user then horizontally installs the second channel of the connecting member to the entire length of the top keder by first inserting an end of the top keder into the corresponding second channel of the connecting member. The second channel (along with the side panel) is horizontally pushed along the length of the top keder until the channel is in receipt of the entire length of the top keder.

DESCRIPTION OF THE PREFERRED EMBODIMENT

Figure 1:
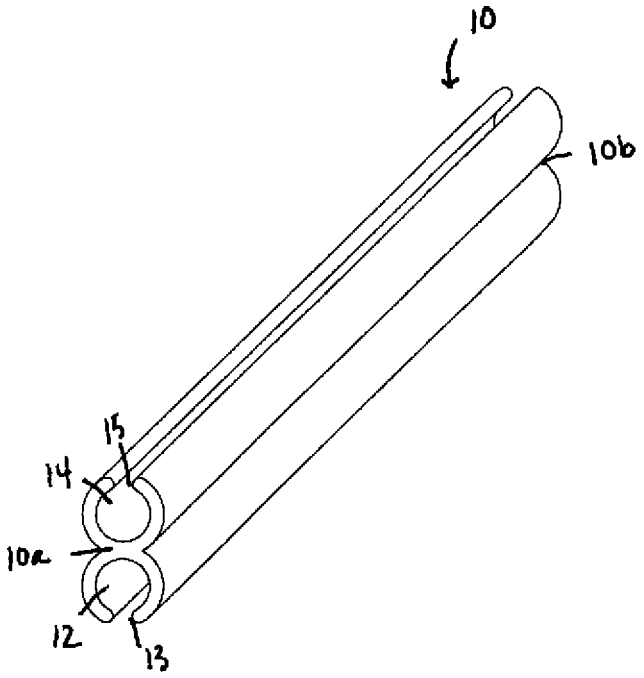
FIG. 1 is a perspective view of a connecting member used in application of the present system, a walls to top closure system for tents.
Figure 2:
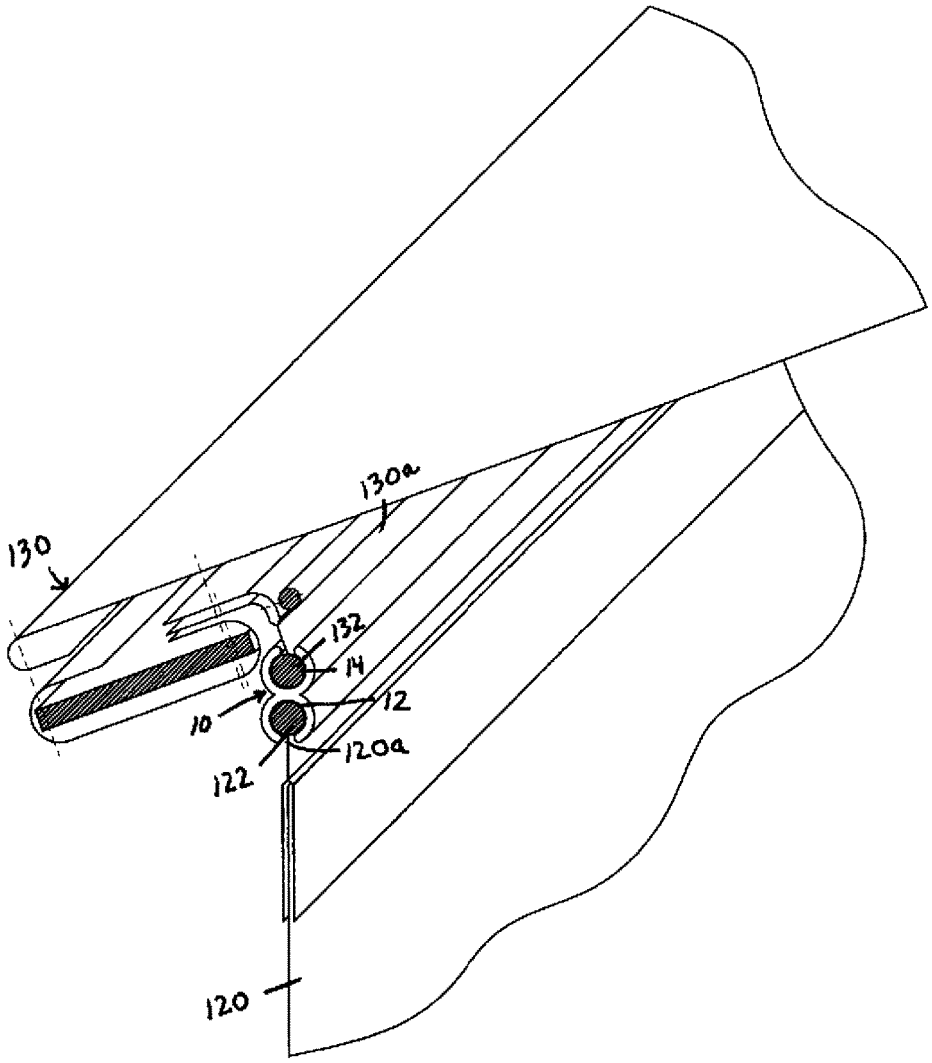
FIG. 2 illustrates the connecting member connecting a tent's fabric sidewall and tent eave according to the present invention.
Figure 3:
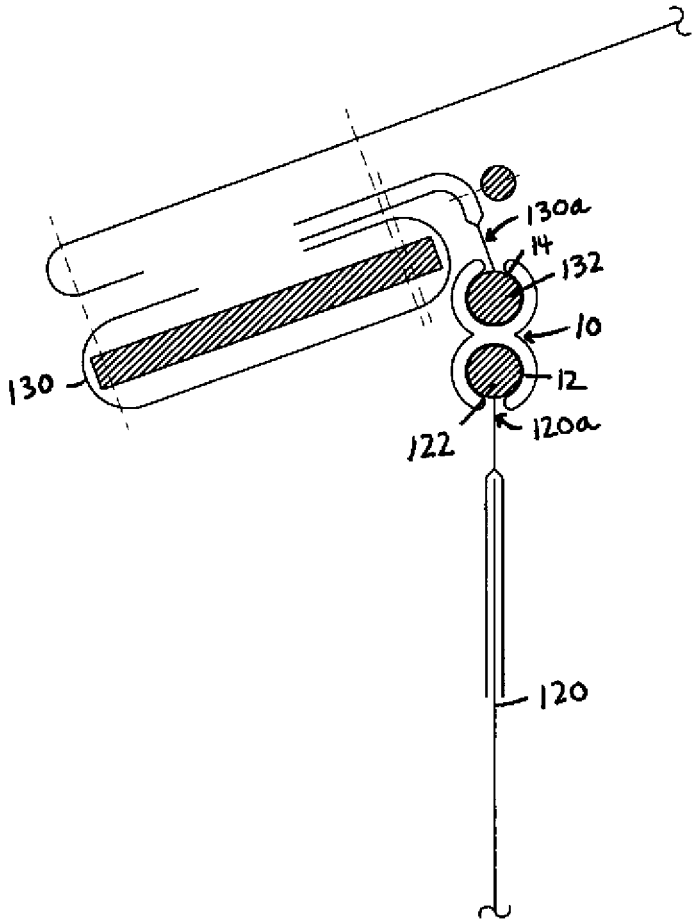
FIG. 3 is an enlarged, side view showing the connecting member illustrated in FIG. 2.

The present invention is directed to a method for assembling a weather-tight connection of the fabric tent walls to the fabric tent eave. The method includes a connecting member configured to receive an uppermost end of the tent's fabric wall and to receive an end of the fabric top (tent's eave). The present invention joins the tent's side wall to the tent eave and eliminates any gaps that let in wind and rain without the need for a valance or any other visual disturbance to the characteristic clean, sharp catenary eave line. As will be described, the walls to top closure system for tents as disclosed further consists of components configured and correlated with respect to each other so as to attain the desired objective.

The tent's fabric shell generally includes the side panels arranged and releaseably joined, during installation, at its uppermost end to the tent's top panels. In application, the uppermost end of the side panels abut in a generally perpendicular relation with an end of the top panels and are appropriately joined together.

As already mentioned in the brief description of prior art, the prior art includes connecting the wall panels with the top panels using hook and loop fasteners or snap, hook, and/or cable fasteners, which, as discussed, are unsuited for properly sealing the walls to the top.

In the present invention, a connecting member 10 acts as a seam connecting the side panels and the top panels of the tent roof.

As illustrated, the tent's side panels 120 each define a keder 122 to facilitate simple and easy engagement with the connecting member 10. More particularly, the keder 122 extends the length of the uppermost end 120*a* of the side panels 120. The connecting member 10 extends the approximate length of the side panels 120 such that a first channel 12 receives the approximate entire length of keder 122 of the sides 120.

Similarly, the top panels 130 define a keder 132 disposed at a lower most edge 130*a* to facilitate simple and easy engagement with the connecting member 10. More particularly, the keder 132 extends the length of the lower most edge 130*a*. The connecting member 10 extends the approximate length of the top panels 130 such that a second channel 14 receives the approximate entire length of keder 132.

As will be understood, the connecting member 10 acts as a seam connecting the side walls 120 to the tent's roof 130, together, forming generally a seamless continuation between the tent's sidewalls and roof.

The first and second channels 12, 14 define narrow openings 13, 15 that extend the length of the channels 12, 14 that prevent the keders (sides 122, and top 132) from being laterally pulled from the first and second channels 12, 14.

In application, the user will first install the tent top with poles, guys and stakes and situate the fabric side panels 120 with the tent.

Connecting the Connecting Member to the Tent's Side Panels

The user horizontally installs the connecting member 10 to the entire length of the side keder 122. In particular, the keder 122 at an end of the side panel 120 is inserted into the corresponding channel 12 of the connecting member 10. Once the end of the side keder 122 is engaged by the connecting member 10, the connecting member 10 can be horizontally urged toward the opposite end of the side panel 120 until the connecting member 10 reaches the opposite end of the side panel 120. During this step, the connecting member 10 is pushed along the length of the uppermost end 120*a* of the side panel 120 until the channel 12 receives the entire length of the side keder 122.

As should be understood, the connecting member 10 moves relative to the side panel 120 during assembly and the fabric keder 122 remains substantially stationary (i.e. little movement) while the user manipulates the position of the connecting member 10 along the length of the side panels 120 as described.

Once the first channel 12 of the connecting member 10 is fully installed along the length of the side panel 120, the connecting member is releaseably locked to the side panels with strap members 20. In particular, side panel 120 preferably includes a pair of straps 20*a*, 20*b* that appropriately attach to corresponding snaps or fasteners 125 disposed on the tent's interior (see FIG. 5), and to corresponding snaps or fasteners 126 disposed on the tent's exterior (see FIG. 4).

Connecting the Connecting Member to the Tent's Eave

With the entire length of the side panel 120 engaged by the connecting member 10 (along with the side panel) as described, the user then horizontally installs the connecting member 10 to the entire length of the top keder 132.

Figure 4:
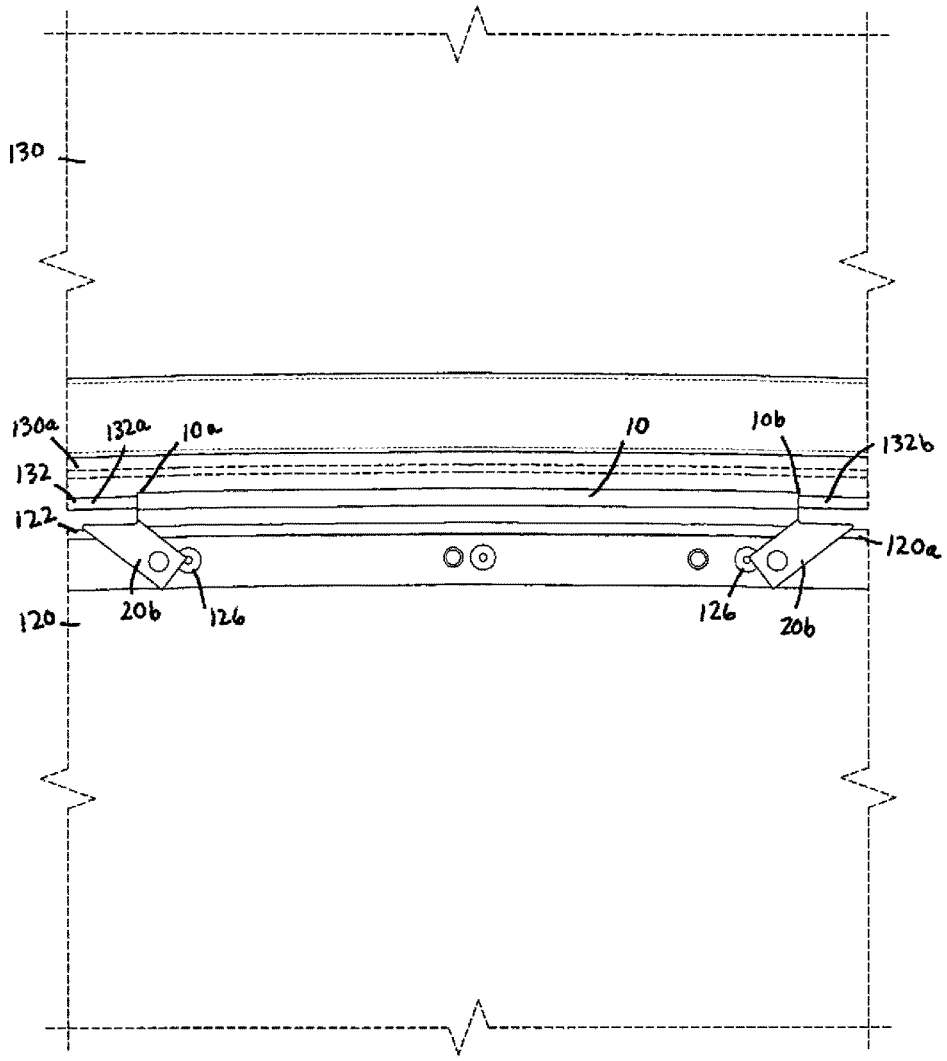
FIG. 4 is an outside view of a tent fabric structure (sidewall and tent eave) illustrating application of the present system.
Figure 5:
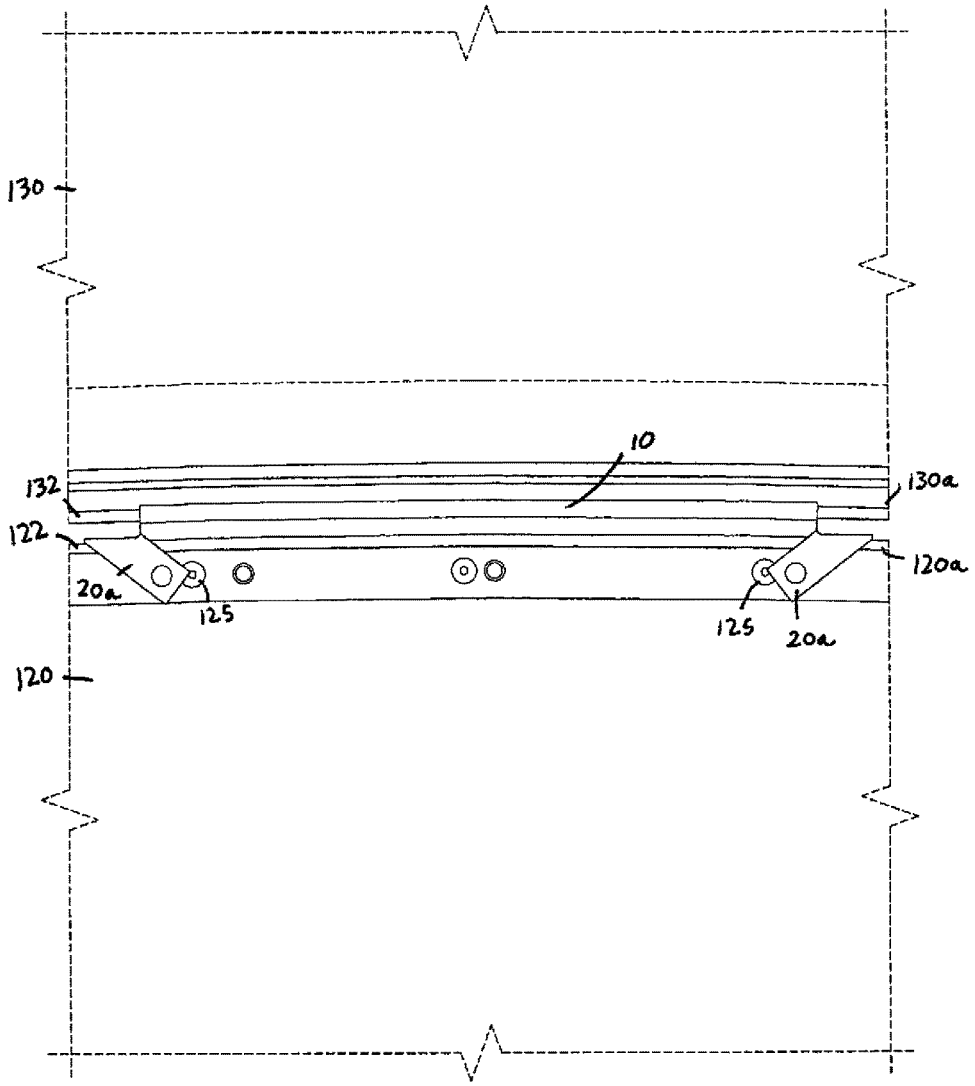
FIG. 5 is an interior view of a tent fabric structure (sidewall and tent eave) illustrating application of the present system.

Referring to FIG. 4, the top panel 130 includes the keder 132 that in FIG. 4, illustrates a first end 132*a* and an opposite end 132*b*. Similarly, the connecting member 10 defines a first end 10*a* that when installed is adjacent first end 132*a* and an opposite end 10*b* that when installed, is adjacent opposite end 132*b*.

To install, the opposite end 132*b* of keder 132 is inserted into the first end 10*a* of the corresponding channel 14 of the connecting member 10. Once the end 132*b* of the top keder 132 is engaged by the connecting member 10, the end 132*b* is horizontally pushed toward the opposite end 10*b* of the channel 14. During this step, the keder end 132*b* is pushed along the length of the second channel 14 until the opposite end 132*b* is adjacent the end 10*b* as shown. As illustrated, the first end 132*a* is then adjacent the end 10*a*, and channel 14 is in receipt of the approximate entire length of the top keder 132.

When installing the top keder 132 as described, the top keder 132 is substantially stationary (i.e. little movement) while the user manipulates the second channel 14 of the connecting member 10 (along with the side panel) along the length of the top keder 132 until the side panel is correctly positioned with the tent top eave.

The channels 12, 14, as described, have narrowed openings 13, 15 that secures the keders within the channels forming the weather-tight seam between the side panels and top of the tent.

In the preferred embodiment, the connecting member 10 is formed of flexible plastic because such an arrangement provides a significant advantage over rigid connecting strips, such as formed of metal. Further, it should be understood that the connecting member 10 is not a load bearing member and has no structural function of its own. The connecting member 10 is not a frame/support member.

Thus, in one form of a method of assembling the connecting member 10 of a tent according to the teachings of the present invention, the method includes resiliently flexing the connecting member 10 so as to be able to engage both panels 120, 130 as described. However, while the connecting member 10 is preferably sufficiently flexible, the connecting member 10 needs to be sufficiently rigid to permit manipulating with the side and top keders as described along the length of the side wall and top panels during assembly without buckling. This rigidity must take into account increasing friction generated by increased engagement between the connecting member 10 and side 120 as the connecting member 10 is pushed along the length of the side 120, as well as the top 130 as the user manipulates the connecting member 10 along the length of the top keder 132.

Although the above description contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A method of forming a weather-tight connection between a tent's side wall and tent's top panels comprising the steps of:

inserting a first end of a side wall keder of a tent's side wall to a first end of a first channel of a connecting member, said connecting member including said first channel and a second channel, wherein each of said first and second channels define a narrow opening that extends the entire length of said first and second channels, urging said first channel horizontally towards an opposite end of said side wall keder until said first end of said side wall keder is approximately adjacent an opposite end of said first channel, wherein during this urging said first channel step the connecting member moves along a length of said side wall while the side wall keder remains substantially stationary, inserting a first end of a top keder of a tent's top panel to a first end of said second channel, said second channel including said first end and an opposite end, and said top keder having a length, urging said first end of said second channel horizontally along said length of said top keder until said first end of said second channel is approximately adjacent an opposite end of said top keder and an opposite end of said second channel is approximately adjacent said first end of said top keder, wherein during this urging said first end step the top keder is substantially stationary while the second channel of the connecting member moves along said length of the top keder, releasably holding said connecting member in place using a first strap member having a first end attached to said tent's exterior adjacent an uppermost end and a second, opposite end of said first strap member configured for attaching to a corresponding first fastener disposed on said tent's interior adjacent said uppermost end, and wherein said first strap member is positioned so that said first strap member abuts a first end of said connecting member, and attaching a first end of a second strap member to said exterior adjacent said uppermost end and a second, opposite end of said second strap member to a corresponding second fastener disposed on said tent's interior adjacent said uppermost end, and wherein said second strap member is positioned so that said second strap member abuts an opposite end of said connecting member.

2. The method of claim 1, wherein said side wall keder is disposed at said uppermost end of said tent's side wall.

3. The method as recited in claim 2, wherein said side wall keder extends the length of said tent's side wall.

4. The method as recited in claim 1, wherein said top keder is disposed at a lowermost edge of said tent's top panel.

5. The method of claim 4, wherein said top keder extends the length of said tent's top panel.

6. A method of forming a weather-tight connection between a tent's side wall and tent's top panels comprising the steps of:

inserting a first end of a side wall keder of a tent's side wall to a first end of a first channel of a connecting member, said connecting member including said first channel and a second channel, wherein said first channel defines a narrow opening sized for receiving said side wall keder, and said second channel defines a narrow opening sized for receiving a top keder, urging said first channel horizontally towards an opposite end of said side wall keder until said first end of said side wall keder is approximately adjacent an opposite end of said first channel, inserting a first end of a top keder of a tent's top panel to a first end of said second channel, said top keder having said first end and an opposite end, and said second channel including said first end and an opposite end, urging said first end of said second channel horizontally along an entire length of said top keder until said first end of said second channel is approximately adjacent said opposite end of said top keder and said first end of said top keder is approximately adjacent said opposite end of said second channel, releasably holding said connecting member in place using a first strap member having a first end attached to an uppermost end of said tent's side wall and a second, opposite end of said first strap member configured for attaching to a corresponding first fastener disposed on said tent's side wall on said tent's interior, and wherein said first strap member is positioned so that said first strap member abuts a first end of said connecting member, and attaching a second end of a second strap member to said uppermost end and a second, opposite end of said second strap member to a corresponding second fastener disposed on said tent's interior adjacent said uppermost end, and wherein said second strap member is positioned so that said second strap member abuts an opposite end of said connecting member.

7. The method of claim 6, wherein said side wall keder is disposed at said uppermost end of said tent's side wall.

8. The method of claim 7, wherein said side wall keder extends the length of said tent's side wall.

9. The method of claim 6, wherein said top keder is disposed at a lowermost edge of said tent's top panel.

10. The method of claim 9, wherein said top keder extends the length of said tent's top panel.

11. A method of forming a weather-tight connection between a tent's side wall and tent's top panels comprising the steps of:

inserting a first end of a top keder of a tent's top panel to a first end of a first channel of a connecting member, said connecting member including said first channel and a second channel, wherein each of said first and second channels define a narrow opening that extends the entire length of said first and second channels, and wherein said top keder is disposed at a lowermost end of said tent's top panel, urging said first channel horizontally towards an opposite end of said top keder until said first end of said top keder is approximately adjacent an opposite end of said first channel, inserting a first end of a side wall keder of said tent's side wall to a first end of said second channel, said side wall keder having said first end and an opposite end, and said second channel including said first end and an opposite end, and wherein said side wall keder is disposed at an uppermost end of said tent's side wall, urging said first end of said second channel horizontally until said opposite end of said side wall keder is approximately adjacent said first end of said second channel and said first end of said side wall keder is approximately adjacent said opposite end of said second channel, releasably holding said connecting member in place using a first strap member having a first end attached to an uppermost end and a second, opposite end of said first strap member configured for attaching to a corresponding first fastener disposed on an interior of said tent's side wall, and wherein said first strap member is positioned so that said first strap member abuts a first end of said connecting member, and attaching a second end of a second strap member to said uppermost end and a second, opposite end of said second strap member to a corresponding second fastener disposed on said interior adjacent said uppermost end, and wherein said second strap member is positioned so that said second strap member abuts an opposite end of said connecting member.

12. The method as recited in claim 11, wherein said side wall keder extends the length of said tent's side wall.

13. The method of claim 11, wherein said top keder extends the length of said tent's top panel.

* * * * *